US012516497B2

(12) United States Patent
De Bruyne et al.

(10) Patent No.: US 12,516,497 B2
(45) Date of Patent: Jan. 6, 2026

(54) SEA-BED MINING VEHICLE

(71) Applicant: Deeptech NV, Ostend (BE)

(72) Inventors: Kris De Bruyne, Antwerp (BE); Harm Stoffers, Dorst (NL); Stéphane Flamen, Antwerp (BE)

(73) Assignee: Deeptech NV, Ostend (BE)

( * ) Notice: Subject to any disclaimer, the term of this patent is extended or adjusted under 35 U.S.C. 154(b) by 696 days.

(21) Appl. No.: 17/801,009

(22) PCT Filed: Feb. 19, 2021

(86) PCT No.: PCT/IB2021/051449
§ 371 (c)(1),
(2) Date: Aug. 19, 2022

(87) PCT Pub. No.: WO2021/165922
PCT Pub. Date: Aug. 26, 2021

(65) Prior Publication Data

US 2023/0094461 A1 Mar. 30, 2023

(30) Foreign Application Priority Data

Feb. 20, 2020 (BE) ..... 2020/5115

(51) Int. Cl.
*E02F 3/92* (2006.01)
*E02F 3/88* (2006.01)
*E02F 3/90* (2006.01)

(52) U.S. Cl.
CPC ..... *E02F 3/9243* (2013.01); *E02F 3/8866* (2013.01); *E02F 3/905* (2013.01)

(58) Field of Classification Search
CPC ..... E02F 3/9243; E02F 3/905; E02F 3/8866; E02F 3/9293; E02F 3/885; E02F 3/8841;
(Continued)

(56) References Cited

U.S. PATENT DOCUMENTS 3,971,593 A 7/1976 Porte et al.
3,975,054 A 8/1976 Brockett, III et al.
(Continued)

FOREIGN PATENT DOCUMENTS

CN 2253391 Y 4/1997
CN 103551231 A 2/2014
(Continued)

*Primary Examiner* — Joseph M Rocca
*Assistant Examiner* — Robert E Pezzuto
(74) *Attorney, Agent, or Firm* — The Webb Law Firm

(57) ABSTRACT

A deep-sea mining vehicle for taking up mineral deposits from a seabed at great depth, the vehicle includes a support frame provided with means for moving the vehicle forward on the seabed, with at least one suction head with an open suction side which is directed toward the seabed and along which the mineral deposits and surrounding water are taken up, and with a temporary storage, connected via a suction conduit to the at least one suction head, for the mineral deposits taken up, temporary storage includes a container with a front wall, a rear wall, side walls, an upper wall, and a bottom, at the position of the upper wall and connecting to the front wall a first connecting part for the suction conduit, and at substantially the same height and connecting to the rear wall a second connecting part for a discharge conduit for discharge of substantially the sucked-up water.

15 Claims, 6 Drawing Sheets

(58) Field of Classification Search
CPC ..... E02F 3/925; E02F 3/8858; E02F 3/907; E02F 3/9206
See application file for complete search history.

(56) References Cited

U.S. PATENT DOCUMENTS

| | | | | |
|---|---|---|---|---|
| 4,232,903 | A | 11/1980 | Welling et al. | |
| 4,368,923 | A * | 1/1983 | Handa | E02F 3/9218 299/8 |
| 4,842,336 | A * | 6/1989 | Erametsa | E02F 3/9293 299/8 |
| 6,003,952 | A | 12/1999 | Smart et al. | |
| 7,785,479 | B1 * | 8/2010 | Hosford | B01D 21/0018 210/801 |
| 9,334,734 | B2 * | 5/2016 | Hong | E02F 3/907 |

FOREIGN PATENT DOCUMENTS

| | | | |
|---|---|---|---|
| CN | 105350968 | A | 2/2016 |
| CN | 106703812 | A | 5/2017 |
| CN | 106907154 | A | 6/2017 |
| CN | 108045988 | A | 5/2018 |
| CN | 108194085 | A | 6/2018 |
| CN | 109630122 | A | 4/2019 |
| GB | 2113274 | A | 8/1983 |
| KR | 101391636 | B1 | 5/2014 |

* cited by examiner

SEA-BED MINING VEHICLE

CROSS-REFERENCE TO RELATED APPLICATIONS

This application is the United States national phase of International Application No. PCT/IB2021/051449 filed Feb. 19, 2021, and claims priority to Belgian Patent Application No. 2020/5115 filed Feb. 20, 2020, the disclosures of which are hereby incorporated by reference in their entirety.

BACKGROUND OF THE INVENTION

Field of the Invention

The invention relates to a deep-sea mining vehicle for collecting mineral deposits on a seabed at great depths and transporting said deposits to a floating device or other storage above water. The invention likewise relates to a method for collecting mineral deposits at great depths with the deep-sea mining vehicle, and to a suction head for use in a deep-sea mining vehicle. The mineral deposits can comprise polymetallic nodules, such as manganese nodules.

Description of Related Art

In view of the growing world population and increasing scarcity of natural resources, there is an increasing need for groundbreaking technologies for deep-sea mining Polymetallic nodules occur on the floors of a number of oceans and contain essential raw materials, such as nickel, cobalt and manganese. After extraction, the metals present in the polymetallic nodules can for instance be applied in stainless steel, batteries, wind turbines, photovoltaic systems and other useful applications.

In deep-sea mining the seabed can lie a distance of 4000-6000 m and more from the sea surface, and deep-sea mining devices must therefore be able to withstand the high pressures and other difficult conditions prevailing at such depths in the vicinity of the seabed.

A deep-sea mining vehicle is generally lowered toward the seabed from a deep-sea mining ship. Use can be made here of launching devices designed particularly for this purpose, which can if desired be adapted to the design of the deep-sea mining vehicle. A riser pipe or riser string arranged between the deep-sea mining vehicle and the deep-sea mining ship further ensures that mineral deposits collected by the deep-sea mining vehicle are carried from the seabed to a storage situated above the water surface. For this purpose the deep-sea mining ship is provided with suitable pumping equipment. If desired, pumps can also be incorporated in the riser string at determined water depths. A flexible connection between the riser string and the deep-sea mining vehicle ensures that the vehicle is able to move relatively freely over the seabed.

It will be apparent that collecting polymetallic nodules and then transporting the collected polymetallic nodules to a floating device above the water surface must take place as efficiently as possible, considering the difficult conditions on site.

SUMMARY OF THE INVENTION

The present invention has for its object, among others, to provide a deep-sea mining vehicle whereby mineral deposits can be collected at great depths with an increased efficiency relative to the prior art.

For this purpose the invention comprises a deep-sea mining vehicle as described herein. The deep-sea mining vehicle for taking up mineral deposits from a seabed at great depth, and optionally transporting said deposits to a floating device, comprises a support frame provided with means for moving the vehicle forward on the seabed in a direction of movement, with at least one suction head with an open suction side which is directed toward the seabed and along which the mineral deposits and surrounding water are taken up, and with a temporary storage, connected via a suction conduit to the at least one suction head, for the mineral deposits taken up, wherein the temporary storage comprises a container with a front wall, a rear wall, side walls, an upper wall and a bottom, wherein the temporary storage further comprises at the position of the upper wall and connecting to the front wall a first connecting part for the suction conduit, and at substantially the same height and connecting to the rear wall a second connecting part for a discharge conduit for discharge of substantially the sucked-up water, wherein the temporary storage further comprises at the position of the bottom and connecting to the interior of the container a third connecting part for a discharge conduit for discharge of substantially the mineral deposits.

The curvature of the wall part, among other things, in combination with the gap-like feed opening and the exit angle of the gap-like feed opening provide for a more efficient take-up of the mineral deposits, such as manganese nodules, from the seabed. The exit angle of the gap-like feed opening preferably lies between 0° and 45° relative to the horizontal plane, preferably between 20° and 40°.

An embodiment of the invention relates to a deep-sea mining vehicle wherein a cross-section of the first connecting part is arcuate in a plane running parallel to the direction of movement.

In yet another embodiment of the invention a deep-sea mining vehicle is provided wherein the second connecting part has an elongate tubular form and extends in a direction running parallel to a width direction of the deep-sea mining vehicle.

A further embodiment is obtained by a deep-sea mining vehicle wherein the second connecting part comprises an internal latticework which covers a throughflow area of the second connecting part and which is configured to stop relatively small mineral deposits or fragments thereof.

Another embodiment relates to a deep-sea mining vehicle wherein the internal latticework can be positioned from outside in positions between a closed position, in which the latticework covers the throughflow area, and an open position in which the latticework covers only a part of the throughflow area.

Yet another embodiment relates to a deep-sea mining vehicle wherein the side walls taper toward the third connecting part for the discharge conduit for discharge of substantially the mineral deposits.

In a further improved embodiment a deep-sea mining vehicle is provided which further comprises means for carrying water under high pressure through the third connecting part and toward the discharge conduit.

Yet another embodiment provides a deep-sea mining vehicle wherein the temporary storage further comprises at the position of the bottom and connecting to the interior of the container an outlet valve.

According to yet another embodiment, the production of the deep-sea mining vehicle can be improved when the vehicle comprises a number of suction heads disposed parallel to each other. The suction heads can here form a connected unit which can be operated collectively. It is preferably also possible to enable individual operation of the suction heads.

It is advantageous here for the deep-sea mining vehicle to be characterized according to an embodiment in that the suction conduits which are attached to the respective suction heads which are disposed parallel to each other connect to the first connecting part.

Yet another embodiment provides a deep-sea mining vehicle wherein the suction head or plurality of suction heads are height-adjustable relative to the seabed.

Another aspect of the invention relates to a temporary storage for a deep-sea mining vehicle according to the invention. The temporary storage comprises a container with a front wall, a rear wall, side walls, an upper wall and a bottom, wherein the temporary storage further comprises at the position of the upper wall and connecting to the front wall a first connecting part for the suction conduit, and at substantially the same height and connecting to the rear wall a second connecting part for a discharge conduit for discharge of substantially the sucked-up water and sediment, wherein the temporary storage further comprises at the position of the bottom and connecting to the interior of the container a third connecting part for a discharge conduit for discharge of substantially the mineral deposits.

According to yet another aspect of the invention, a method is provided for taking up mineral deposits on a seabed at great depth and optionally transporting said deposits to a floating device. The method comprises of providing a deep-sea mining vehicle according to the invention, connecting the deep-sea mining vehicle to a suspension cable provided between the floating device and the deep-sea mining vehicle, lowering the deep-sea mining vehicle toward a seabed, moving the deep-sea mining vehicle forward over or on the seabed in order to take up the mineral deposits, and optionally hauling in the deep-sea mining vehicle toward the floating device after collecting of the mineral deposits.

The embodiments of the invention described in this patent application can be combined in any possible combination of these embodiments, and each embodiment can individually form the subject-matter of a divisional patent application.

BRIEF DESCRIPTION OF THE DRAWINGS

The invention will now be further elucidated on the basis of the following figures and description of a preferred embodiment, without otherwise being limited thereto. In the figures.

DESCRIPTION OF THE INVENTION

Figure 1:
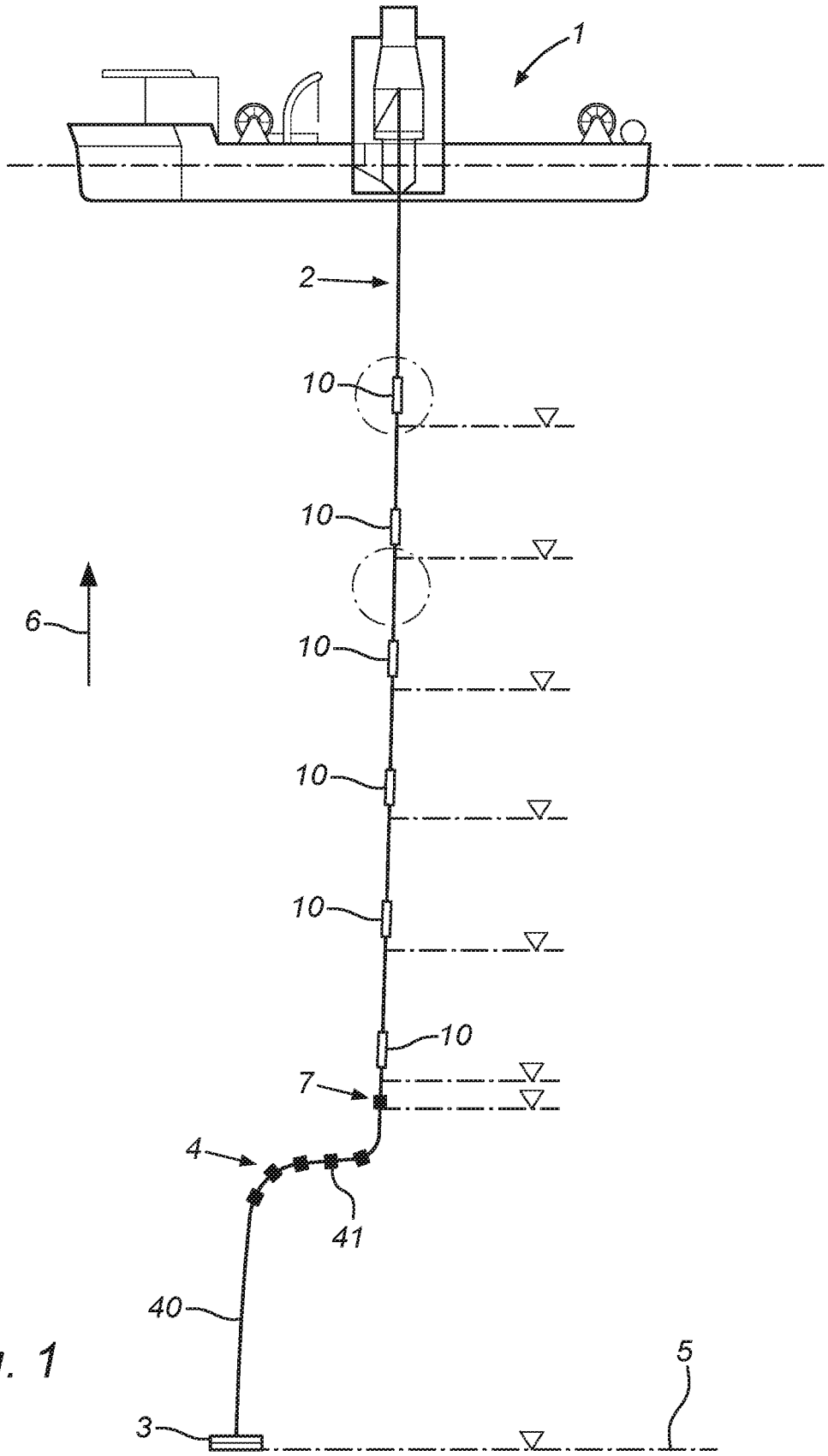
FIG. 1 is a schematic side view of an assembly of a floating vessel and a riser pipe connected thereto, to an underside of which is connected a deep-sea mining vehicle according to an embodiment of the invention.

Referring to FIG. 1, a part is shown of a typical setup which is used in deep-sea mining of mineral deposits, such as polymetallic nodules. The setup typically comprises a transport system in the form of a tubular riser string 2 (which can have a length of several thousands of metres and connects to a floating vessel 1) to which mining equipment such as a deep-sea mining vehicle 3 is attached. A flexible connecting hose assembly 4 can be arranged between the lower end 7 of riser pipe 2 and the deep-sea mining vehicle 3 which is adapted to move on a deep-sea floor 5 and to collect mineral deposits therefrom.

Connecting assembly 4 comprises a flexible undersea hose 40 which is adapted to transport mineral nodules collected by vehicle 3 to the rigid riser pipe 2. Hose 40 can be provided with floating blocks 41 which compensate for the components' own weight and generate an upward force in a part of the hose and create an S-shape. Flexible connecting assembly 4 enables mining vehicle 3 to have a determined degree of freedom to move around on seabed 5, and ensures that the vehicle is not affected by the movements of riser pipe 2. In order to support and lift vehicle 3 steel hoisting cables (not shown) can be provided between the vessel 1 and the deep-sea mining vehicle 3.

If desired, the transport system in the form of a tubular riser string 2 of extreme length can also comprise a number of pump modules 10 which are arranged in lengthwise direction. Pump modules 10 are adapted to pump up mineral deposits (nodules) from seabed 5 in an upward direction 6, which is oriented away from seabed 5 toward the sea surface. It is also possible to provide one pumping station (not shown) at the position of a lower side of riser string 2.

Figure 2:
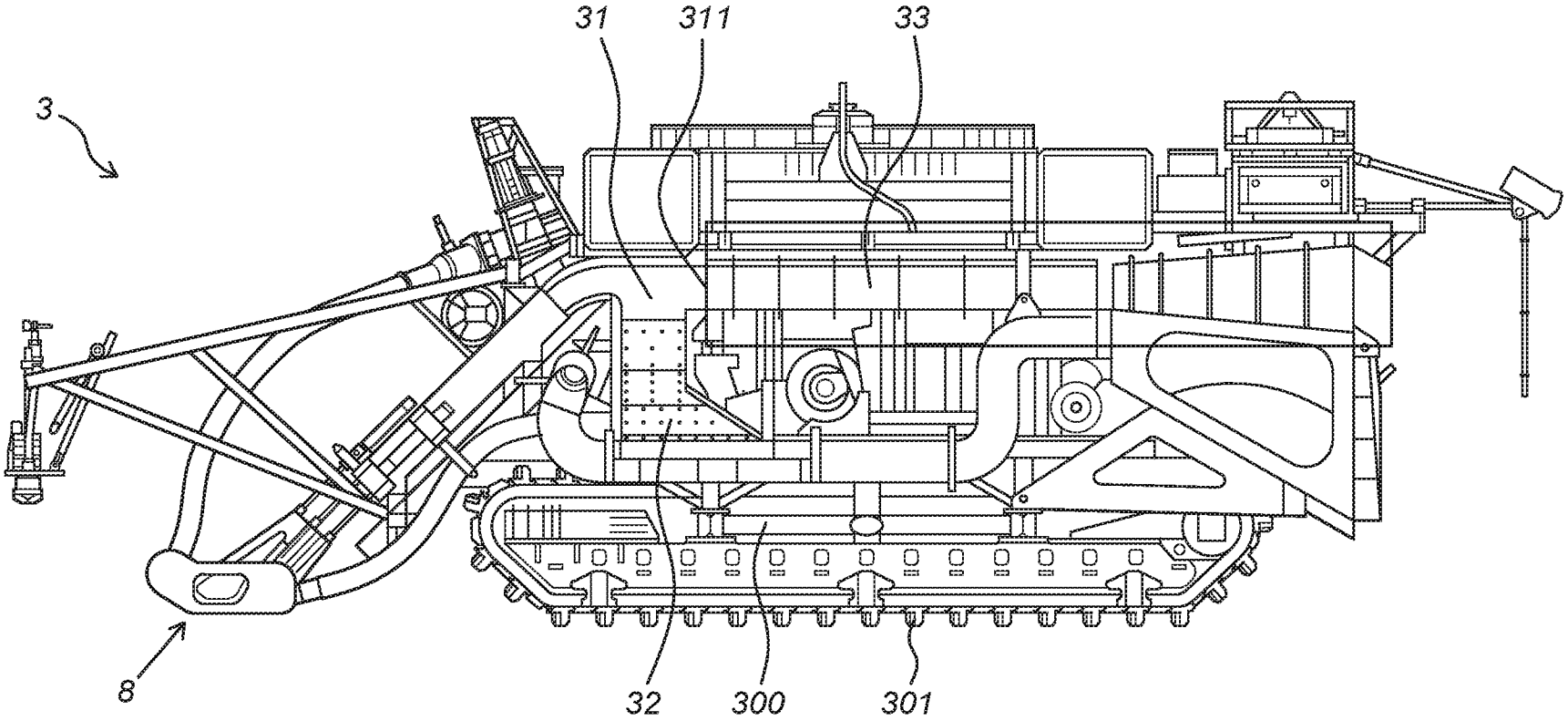
FIG. 2 is a schematic side view of a deep-sea mining vehicle according to an embodiment of the invention.

FIG. 2 shows a deep-sea mining vehicle 3 according to a preferred embodiment of the invention. Deep-sea mining vehicle 3 typically comprises a support frame 300 which is provided with means 301 for enabling deep-sea mining vehicle 3 to be moved, for instance over the seabed. Such means can take the form of caterpillar tracks 301, wheels or other moving means.

In order to be able to take up mineral deposits support frame 300 is typically provided with a nodule collecting head 8, a hopper 32 and an outlet 33. A mixture of, among other things, water and mineral deposit, which is taken up by nodule collecting head 8, is transported from the seabed into deep-sea mining vehicle 3. In deep-sea mining vehicle 3, particularly in separating space 31, the mixture is split into at least two parts, for instance by arranging a filter 311 at an entrance of outlet 33. The mineral nodules are thus separated from the greater part of the water and several finer particles of the mixture. The water and finer particles of the mixture are ejected via outlet 33, back into the surrounding area. The cross-section of outlet 33 increases toward the outer end so as to reduce the exit speed of the mixture at the rear side of the deep-sea mining vessel.

The mineral nodules are captured in hopper 32, which in this case serves as storage or as temporary storage. When deep-sea mining vehicle 3 forms part of a deep-sea mining setup as shown in FIG. 1, mineral nodules are optionally pumped via this temporary storage, optionally via a central discharge pipe of deep-sea mining vehicle 3, to the hose 40. The hopper is provided with oblique walls (10°-40°) on both sides, optionally provided with jet feed openings for concentrating nodules toward the central discharge pipe. A central water flow at the bottom of the hopper, created by a supply pump, ensures that the nodules are guided into the central discharge pipe.

In another embodiment it is possible for deep-sea mining vehicle 3 to be provided with a nodule bin (not shown) for collecting the mineral nodules.

Figure 3:
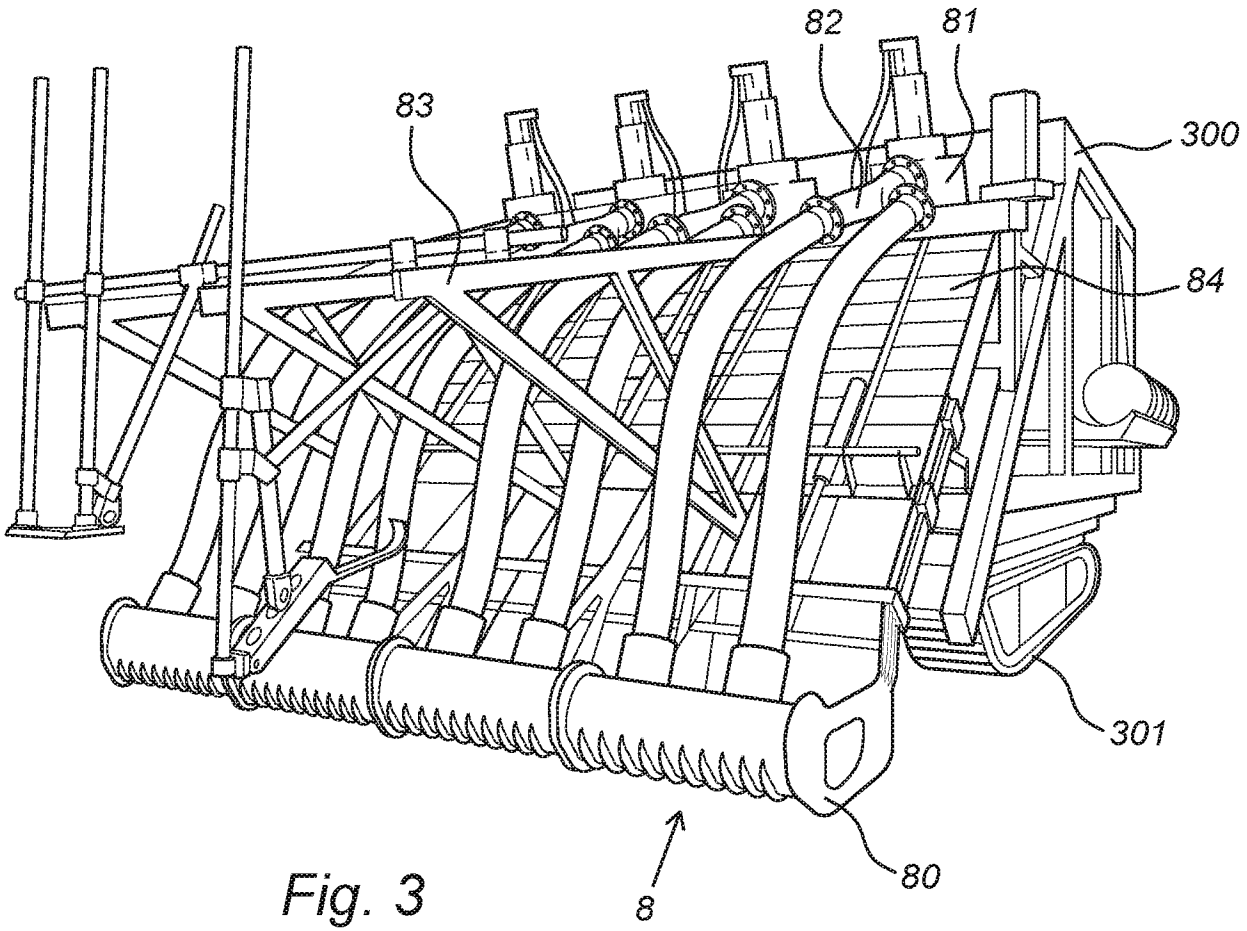
FIG. 3 is a schematic perspective front view of a deep-sea mining vehicle according to an embodiment of the invention.

FIG. 3 shows a schematic perspective front view of deep-sea mining vehicle 3 according to an embodiment of the invention. From this perspective, it can once again be seen that deep-sea mining vehicle 3 comprises support frame 300 and caterpillar tracks 301. This perspective particularly shows that deep-sea mining vehicle 3 can, in addition to one, also comprise a plurality of nodule collecting heads 8 disposed parallel to each other.

In a situation of use such nodule collecting heads 8 spray water onto the seabed at a high speed so as to thus mix mineral deposit situated there with the supplied and surrounding water.

These nodule collecting heads 8 typically consist of pump 81, which provides water via one or more supply conduits to suction head 80 at a high pressure. Pump 81 can also be shared between two or more nodule collecting heads, wherein it provides water to both heads. From suction head 80 water is sprayed onto the seabed at high speed, such that mineral deposits which may be situated there are mixed with the supplied and surrounding water. This mixture of water and seabed is taken up via the nodule collecting heads into deep-sea mining vehicle 3, after which it is processed as described above with reference to FIG. 2. From head 80, the mixture is received by means of suction conduit 84 in nodule collecting head 8.

The one or more nodule collecting heads 8 can be controlled on the basis of measurements taken of the surrounding area via a measuring installation mounted on a measuring installation frame 83.

Figure 4:
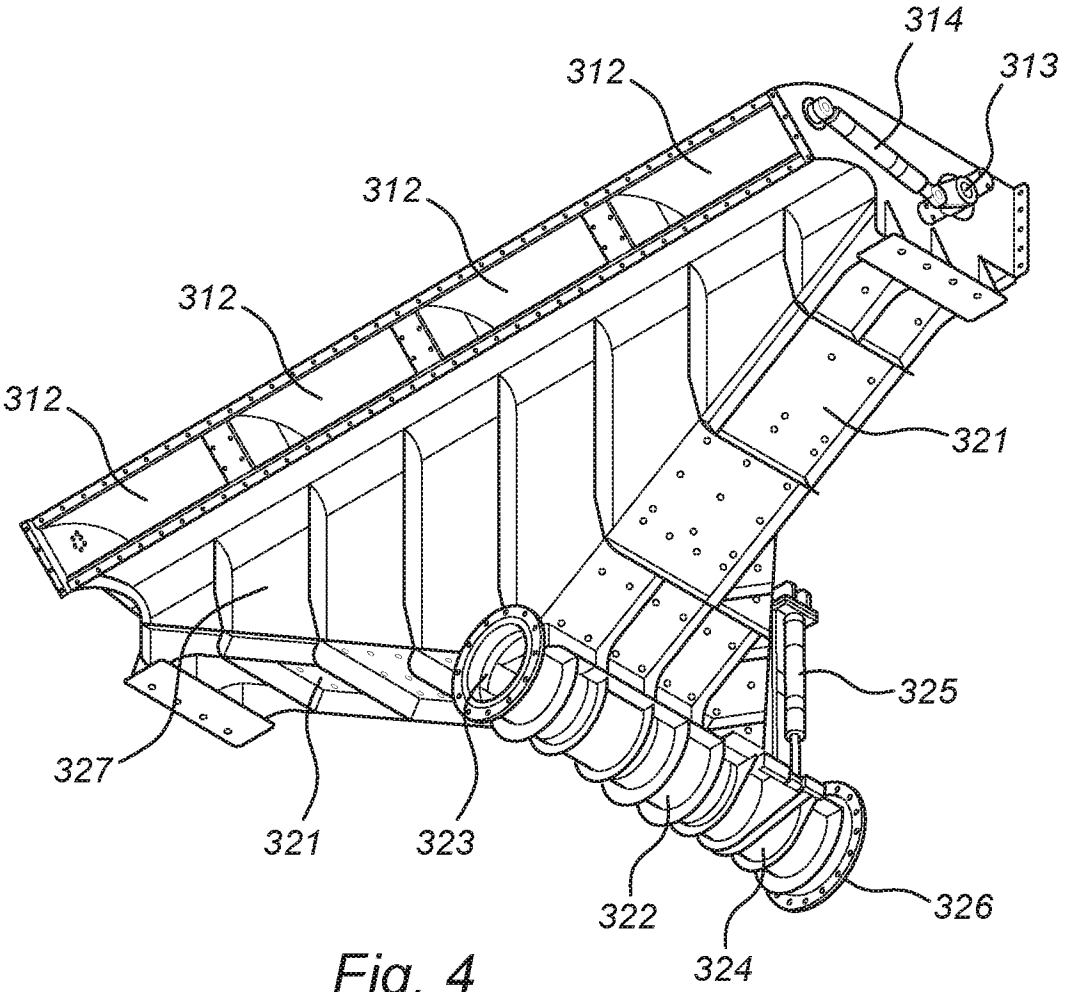
FIG. 4 is a schematic perspective front view of a hopper of the deep-sea mining vehicle according to an embodiment of the invention.

FIG. 4 shows a perspective front view of a temporary storage which can form part of deep-sea mining vehicle 3. The temporary storage comprises a container which, in this embodiment, is embodied by hopper 32. Situated in an upper part of front wall 327 of hopper 32 are connecting parts 312, wherein the number of connecting parts 312 corresponds to the number of suction conduits 84 to be connected thereto. In this embodiment connecting parts 312 have an elongate tubular form and extend in a direction parallel to a width direction of deep-sea mining vehicle 3. The form of connecting parts 312 should in any case be such that they can be coupled sealingly to suction conduits 84.

Separating space 31 is situated in the upper part of hopper 32 and shown on the sides thereof is shaft 313, which is connected to an internal latticework 311 arranged inside hopper 32 and can be controlled or moved via actuator 314 between a partially open and a closed position.

In this embodiment front wall 327 and the rear wall lying opposite thereto (not shown in this figure) of hopper 32 taper downward to a point and are attached to each other by the respective side walls 321. Where side walls 321 converge at the bottom, hopper 32 is further provided with a connecting part which, in this embodiment, is attached to a discharge conduit 322 which has a round cross-section in this embodiment. Discharge conduit 322 is provided with a feed opening 323, discharge opening 326 and an outlet valve 324, wherein the outlet valve is controlled by actuator 325.

Figure 5:
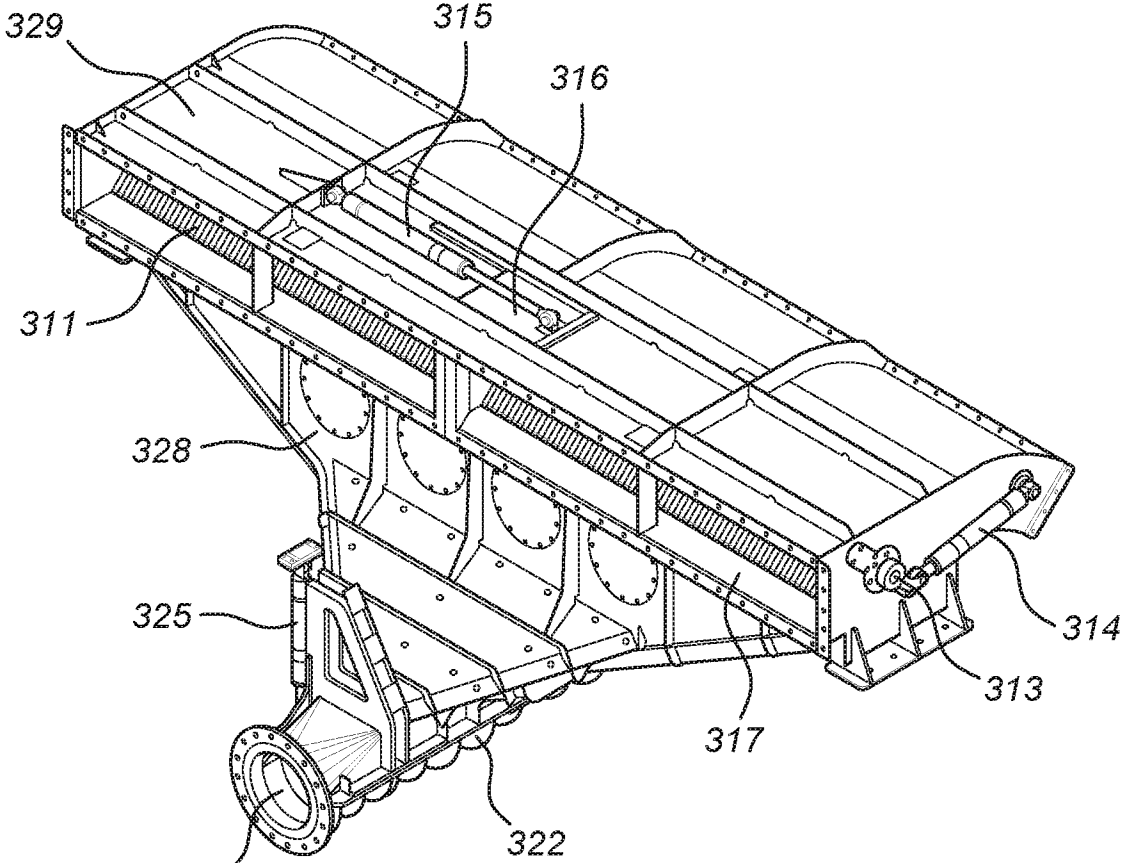
FIG. 5 is a schematic perspective rear view of a hopper as shown in FIG. 4.

FIG. 5 shows a perspective rear view of hopper 32. In this view it can once again be seen that the container of the temporary storage consists of hopper 32. This view particularly shows that hopper 32 also comprises an upper wall 329 and a rear wall 328. Upper wall 329 fully closes the temporary storage and follows a curved form on the front side so as to connect smoothly to connecting parts 312. The cross-section of connecting part 312 is hereby arcuate in a plane running parallel to the direction of movement. Upper wall 329 is also provided with a sliding hatch 316 which is controlled by actuator 315. The sliding flap or sliding hatch 316 is configured to be opened in the so-called splash zone, which is defined as the transition zone between air and water at the surface. Sliding flap 316 functions as a venting flap. Sliding flap 316 can also be opened when the deep-sea mining vessel is brought on board of the vessel so that no or less underpressure can be formed when the water flows out of the hopper.

Situated in an upper part of rear wall 328 of hopper 32 are further rear connecting parts 317 to which a discharge conduit of outlet 33 can be attached. The throughflow of the water supplied via suction conduit 84 is best when connecting parts 312 and rear connecting parts 317 are at roughly the same height, preferably at the top of the respective walls in which they are arranged, in the direction of upper wall 329. These rear connecting parts 317 can also have an elongate tubular form and extend in a direction parallel to a width direction of the deep-sea mining vehicle. The latticework 311 can be arranged in these rear connecting parts 317. Discharge opening 326 of discharge conduit 322 can also be seen in this view.

An obliquely running part of rear wall 328 helps enhance the throughflow of the mineral deposits to discharge pipe 326.

Figure 6:
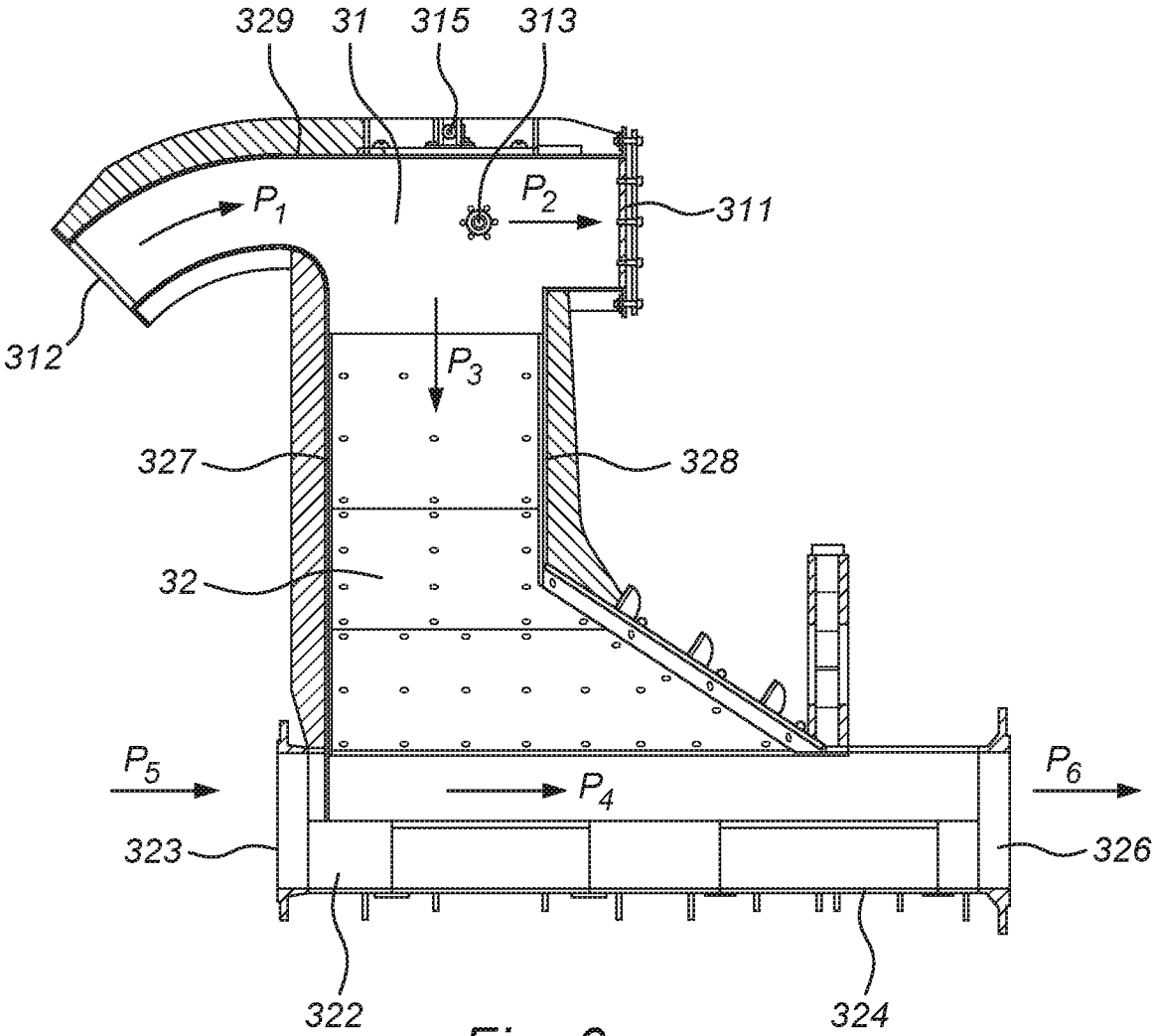
FIG. 6 is a schematic cross-section through the centre line of the hopper shown in FIGS. 4 and 5.

FIG. 6 shows a schematic cross-section through the centre line of hoppers 32 according to FIGS. 4 and 5. In this cross-section it can once again be seen that hopper 32 consists of front wall 327, rear wall 328, upper wall 329 and is attached on the underside via a further connecting part to discharge conduit 322.

The mixture of water and mineral deposits drawn in through suction conduit 84 is received via connecting parts 312 arranged in front wall 327 in separating space 31 ($P_1$), which is situated at the top of hopper 32. Situated in rear wall 328, opposite connecting parts 312, are one or more rear connecting parts 317. The mineral nodules are thus separated from the greater part of the water and several finer particles of the mixture. The water and finer particles of the mixture flow out of the separating space 31 via filter 311 ($P_2$). These particles are ejected via outlet 33. The finer particles of the mixture can also be stored in deep-sea mining vehicle 3 and/or be pumped upward via the riser string.

In the separating space mineral nodules will drop out of the water flow from connecting parts 312 to rear connecting part 317 ($P_3$) due to the force of gravity. It is also possible for an internal latticework 311 to be arranged in the upper water flow, which latticework can be positioned via shaft 313. Such a latticework can particularly be positioned in a closed position in which the internal latticework can be positioned from outside in positions between a closed position, in which the latticework covers the throughflow area and thus forces the mineral nodules from the upper water flow, and an open position in which the latticework covers only a part of the throughflow area. In the open position latticework 311 can be flushed, which is understood to mean that undesired materials, such as clay and other undesired material, are removed from the latticework.

Due to the form of hopper 32 these mineral nodules are brought together toward the lower connecting opening and discharge conduit 322. In order to discharge the mineral nodules further an undercurrent is provided through discharge conduit 322. For this purpose new process water is pumped into feed opening 323 ($P_5$), which results in a suction effect in the longitudinal direction of the deep-sea mining vehicle, which will entrain mineral nodules falling into the hopper ($P_4$) and transport them toward the discharge pipe or an alternative storage on deep-sea mining vehicle 3 ($P_6$).

When a blockage occurs and the outlet valve must be opened, nodule collecting head 8 is set such that a maximum volume of liquid can be received.

The invention is not limited to the above described embodiment and also comprises modifications thereto to the extent these fall within the scope of the claims appended below.

The invention claimed is:

1. A deep-sea mining vehicle for taking up mineral deposits from a seabed at great depth, wherein the vehicle comprises:

a support frame provided with means for moving the vehicle forward on the seabed in a direction of movement, with at least one suction head with an open suction side which is directed toward the seabed and along which the mineral deposits and surrounding water are taken up and led to a suction conduit of the vehicle, and with a temporary storage, connected via the suction conduit to the at least one suction head, for the mineral deposits taken up, wherein the temporary storage comprises a container with a front wall, a rear wall, side walls, an upper wall and a bottom, wherein the temporary storage further comprises at a position of the upper wall and connecting to the front wall a first connecting part for the suction conduit, and at substantially a same height and connecting to the rear wall, a second connecting part for an upper discharge conduit for discharge of substantially the sucked-up water, wherein the temporary storage further comprises at a position of the bottom and connecting to the interior of the container a third connecting part for a lower discharge conduit for discharge of substantially the mineral deposits, wherein the second connecting part has an elongate tubular form and extends in a parallel direction to a width direction of the deep-sea mining vehicle, wherein the third connecting part has an elongated tubular form and extends in a longitudinal direction of the deep-sea mining vehicle.

2. The deep-sea mining vehicle according to claim 1, wherein the first connecting part has an elongate tubular form and extends in a direction running parallel to a width direction of the deep-sea mining vehicle.

3. The deep-sea mining vehicle according to claim 1, wherein a cross-section of the first connecting part is arcuate in a plane running parallel to the direction of movement.

4. The deep-sea mining vehicle according to claim 1, wherein the second connecting part comprises an internal latticework which covers a throughflow area of the second connecting part and which is configured to stop relatively small mineral deposits or fragments thereof.

5. The deep-sea mining vehicle according to claim 4, wherein the internal latticework can be positioned from outside in positions between a closed position, in which the latticework covers the throughflow area, and an open position in which the latticework covers only a part of the throughflow area.

6. The deep-sea mining vehicle according to claim 1, wherein the side walls taper toward the third connecting part for the lower discharge conduit for discharge of substantially the mineral deposits.

7. The deep-sea mining vehicle according to claim 1, further comprising means for carrying water at a high flow rate and exit speed through the third connecting part and toward the lower discharge conduit for discharge of substantially the mineral deposits.

8. The deep-sea mining vehicle according to claim 1, wherein the temporary storage further comprises an outlet valve at the position of the bottom and the outlet valve is connected to the interior of the container.

9. The deep-sea mining vehicle according to claim 1, comprising a plurality of suction heads disposed parallel to each other.

10. The deep-sea mining vehicle according to claim 9, wherein a plurality of suction conduits are attached to the plurality of suction heads which are disposed parallel to each of the suction conduits and connected to the first connecting part.

11. The deep-sea mining vehicle according to claim 1, wherein the at least one suction head is height-adjustable relative to the seabed.

12. The deep-sea mining vehicle according to claim 1, further configured for transporting the deposits to a floating device.

13. A method for taking up mineral deposits on a seabed at great depth, the method comprising: providing a deep-sea mining vehicle according to claim 1, connecting the deep-sea mining vehicle to a suspension cable provided between a floating device and the deep-sea mining vehicle, lowering the deep-sea mining vehicle toward a seabed, and moving the deep-sea mining vehicle forward over or on the seabed in order to take up the mineral deposits.

14. The method according to claim 13, further comprising the step of transporting the deposits to the floating device.

15. The method according to claim 13, further comprising the step of hauling in the deep-sea mining vehicle toward the floating device.

* * * * *